US006522757B1

(12) United States Patent
Hiramatsu et al.

(10) Patent No.: US 6,522,757 B1
(45) Date of Patent: Feb. 18, 2003

(54) BASS INTENSIFICATION DEVICE FOR SPEAKER SYSTEM

(75) Inventors: Shigenori Hiramatsu, 1994-74 Migimomi, Tsuchiura-shi, Ibaragi (JP); Fuminori Sato, Mitaka (JP); Koji Osuga, Mitaka (JP); Akihiro Ozono, Mitaka (JP); Yuichi Honda, Mitaka (JP)

(73) Assignees: Shigenori Hiramatsu, Tsuchiura (JP); Azden Corporation, Tokyo (JP)

( * ) Notice: Subject to any disclaimer, the term of this patent is extended or adjusted under 35 U.S.C. 154(b) by 0 days.

(21) Appl. No.: 09/265,404

(22) Filed: Mar. 10, 1999

(30) Foreign Application Priority Data

Jun. 6, 1997 (JP) ..... 9-165146

(51) Int. Cl.[7] ..... H04R 3/00
(52) U.S. Cl. ..... 381/96; 381/349
(58) Field of Search ..... 381/96, 335, 339, 381/337, 345, 349, 350; 181/156, 199

(56) References Cited

U.S. PATENT DOCUMENTS 4,139,075 A * 2/1979 Kobayashi et al. ..... 181/148
5,189,706 A * 2/1993 Saeki ..... 181/155
5,327,504 A * 7/1994 Hobelsberger ..... 381/350

FOREIGN PATENT DOCUMENTS

| | | | | |
|---|---|---|---|---|
| GB | 2122051 A | * | 1/1984 | ..... 381/96 |
| JP | A-3-232399 | | 10/1991 | |
| JP | A-5-176389 | | 7/1993 | |
| JP | A-5-176390 | | 7/1993 | |

* cited by examiner

*Primary Examiner*—Ping Lee
(74) *Attorney, Agent, or Firm*—Oliff & Berridge, PLC

(57) ABSTRACT

In a bass intensifying device for a speaker system, a passive radiator (5) constructed by a speaker having a voice coil (7) is disposed at a location where it receives a sound pressure from a main speaker (1) driven by a main amplifier (4). A motion feed-back circuit independently of the main amplifier (4) for driving the main speaker (1) is connected to this passive radiator (5). Since the motion feed-back circuit is closed only in the passive radiator (5), it is possible to reinforce the bass while preventing the motion feed-back circuit from degrading the sound quality of the main speaker (1). The selection of the main amplifier 4 for driving the main speaker is free.

4 Claims, 3 Drawing Sheets

BASS INTENSIFICATION DEVICE FOR SPEAKER SYSTEM

BACKGROUND OF THE INVENTION

1. Field of the Invention

The present invention relates to a bass intensifying device for a speaker system, which is used in an audio system, a personal computer or the like.

2. Description of Related Art

Various attempts have been made to realize the high fidelity reproduction since it is preferable for an audio system to reproduce the original sound with a high fidelity. One of them is a negative feed-back (NFB) circuit which is generally applied to an amplifier circuit. The NFB circuit was initially applied only to the amplifier circuit, but gradually applied in a system including a speaker system. The reason is that although the speaker is the lowest in performance within the audio system, since the improvement is made only on a drive circuit for the speaker without any attempt to the speaker (of course, the speaker per se may be studied and improved), which would not be led to a satisfactory result.

In order to improve the sound quality, in particular, reproduce the low-frequency sound with a high fidelity, the use of a large diameter speaker is required, since the reproduction of the low-frequency sound needs to vibrate a corn at a large amplitude. However, in a practical use, there are many cases where the large diameter speaker can not be used. For example, a miniature audio system is included in those cases. Further, an audio monitoring speaker of a personal computer is also included in those cases. Each of them is strongly required to reproduce the low-frequency band, but is small in diameter.

As an attempt to reproduce lower frequency band with a certain diameter speaker, a bass intensifying device called a passive radiator has been invented and put into practice. The device is designed as follows: A speaker is disposed in place to receive a sound pressure generated by a main speaker (an active speaker) driven by an output of an amplifier (the former speaker may dispense with a magnetic circuit as long as it has a corn for vibration) so as to generate the sound (the low-frequency sound) by the action of resonance with the sound pressure generated by the main speaker. This resonance speaker is generally called a passive radiator.

This technology has been investigated in various manners as disclosed in patent applications. For example, Japanese Patent Application Laid-Open Nos. Hei 5-176389 and Hei 5-176390 disclose an enclosure (a box) having two separate internal spaces (cavities), in which a driver unit (a speaker) driven by an amplifier is installed in a first cavity, whereas a passive radiator is installed in a second cavity distinct from the first cavity. In that enclosure, a sensor is provided to detect the vibration of the driver unit, and the amplifier is feed-back controlled in accordance with the output of this sensor.

Japanese Patent Application Laid-Open No. Hei 3-232399 discloses another arrangement in which a passive radiator is provided with means for detecting the vibration thereof so that an amplifier for driving a main speaker is feed-back controlled in accordance with the output of the means.

Either of these prior art arrangements can provide an advantageous effect in reproduction of the low band.

SUMMARY OF THE INVENTION

The present invention is originated from a concept completely different from these technologies, and an object thereof is to realize a satisfactory low-band compensation with a compensation system independently of a signal transmission system of a main speaker without the use of the feed-back control of a main speaker driving amplifier system which was disclosed in the aforementioned patent laid-open applications. A bass intensifying device for a speaker system, according to the present invention, is characterized in that a passive radiator constructed by a speaker having a magnetic circuit is disposed at a location where it receives a sound pressure from a main speaker driven by an amplifier, and a motion feed-back circuit independently of a drive circuit of the main speaker is connected to the passive radiator.

In a bass intensifying device for a speaker system according to the present invention, it is preferable that the main speaker and the passive radiator are installed in a closed type enclosure.

In a bass intensifying device for a speaker system according to the present invention, it is preferable that the main speaker and the passive radiator are installed in a bass-reflection type enclosure.

In association with the activation of the main speaker, a corn of the passive radiator Is vibrated. This vibration is received by the magnetic circuit of the passive radiator to generate an audio current. This audio current is subjected to signal processing with a differential-input buffer amplifier, an integrating MFB amplifier, a velocity MFB amplifier and a summing amplifier, and then power-amplified to be applied to the magnetic circuit of the passive radiator again. This makes the activation of the passive radiator continuous.

Owing to the above-noted circuit, the passive radiator is servo-controlled to cancel the stiffness acting on the passive radiator. In a case where the main speaker and the passive radiator are installed in the closed type or bass-reflection type enclosure, the enclosure arrangement cooperatively functions to the servo-control, to thereby realize more excellent bass reproduction.

A speaker unit having a magnetic circuit is used as the passive radiator, and a motion feed-back loop (a MFB loop) that is independent of the main unit and that is closed only in the passive radiator is constructed so that the MFB effectively cancels the stiffness acting on the passive radiator. This makes the activation band of the passive radiator enlarged toward low frequency band, and lowers the bass reproduction limit frequency of the speaker system remarkably, thereby enabling the super-bass sound reproduction with a miniature system.

DETAILED DESCRIPTION OF THE PREFERRED EMBODIMENTS

Figure 1:
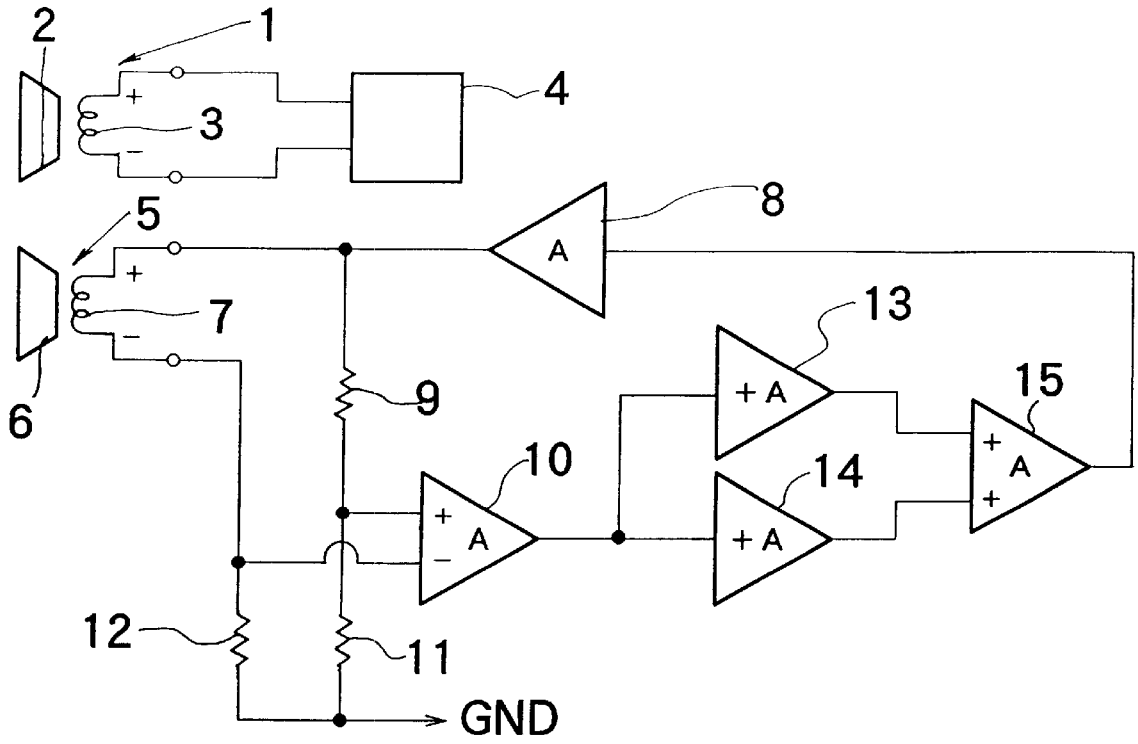
FIG. 1 is a circuit diagram showing an embodiment of the present invention.

Preferred embodiments of the present invention will be described in detail with reference to the accompanying drawings. In FIG. 1, reference numeral 1 designates a main speaker, 2, a corn, and 3, a voice coil forming a magnetic circuit. The voice coil 3 is connected to an output side of a main amplifier 4. A passive radiator 5 is disposed at a location close to the main speaker 1 to receive the sound pressure from the main speaker 1 when the main speaker 1 is activated. This passive radiator 5 is constructed by a speaker having a corn 6 and a voice coil 7 forming a magnetic circuit. The activation of the main speaker 1 results in the flow of an audio current through the voice coil 7.

One end (a positive side) of the voice coil 7 of the passive radiator 5 is connected to the output side of a power amplifier 8 and one end of a resistor 9. The other end of the resistor 9 is connected to a positive side input end of a differential-input buffer amplifier (a balanced-input buffer amplifier) 10 and one end of a resistor 11. The other end of the resister 11 is connected to a grounding circuit to which the other end (a negative side) of the voice coil 7 and a negative side input end of the differential-input buffer amplifier 10 are also connected through a resistor 12. The differential-input buffer amplifier 10 functions to remove an input level difference of the input ends, and is 0 dB in amplitude level.

Input ends of an integrating MFB amplifier 13 and a velocity MFB amplifier 14 are connected to the output side of the differential-input buffer amplifier 10. The integrating MFB amplifier 13 attenuates the high band of an input signal at a attenuation rate of−6 dB/oct through its internal integrating circuit and generates a signal having a phase difference of 90 degree. Since this signal is fed back to equivalently cancel the stiffness acting on a diaphragm of the passive radiator, a minimum resonance frequency of the passive radiator 5 is lowered and thus a bass reproduction limit frequency is lowered. The velocity MFB amplifier 14 amplifies a signal to be fed back, which is in proportion to a diaphragm velocity of the passive radiator 5. Thus, it is possible to obtain a state in which an electromagnetic braking resistance of the passive radiator 5 is equivalently small, and to increase a Q value of the vibration of the diaphragm of the passive radiator 5 which becomes equivalently small due to the decrease of the stiffness by the integrating MFB, thereby being capable of compensating the decrease of the bass reproduction level.

The output ends of these amplifiers 13 and 14 are connected to an input end of a summing amplifier 15 that is 0 dB in amplifying level and has a flat characteristic. An integrating MFB signal and a velocity MFB signal are added in a summing amplifier 15 to output an add signal. The output end thereof is connected to an input side of a power amplifier 8 that is 26 dB in amplifying level.

The circuit thus constructed decreases the audio current generated in the voice coil 7 of the passive radiator 5. That is, the circuit decreases the electromagnetic force caused due to the flow of the audio current through the electric resistance of the voice coil per se, and functions to increase the vibration. Therefore, this circuit activates as a positive feed-back circuit and this is proved by drawing the Nyquist diagram. Accordingly, if no consideration is given, the self-resonance is caused to damage the voice coil 7. To avoid this, by applying the stability criterion of Nyquist, the gain of the velocity MFB and the gain of the integrating MFB are determined through a strict and practical process to be optimum values within a predetermined range providing the stability.

Figure 2:
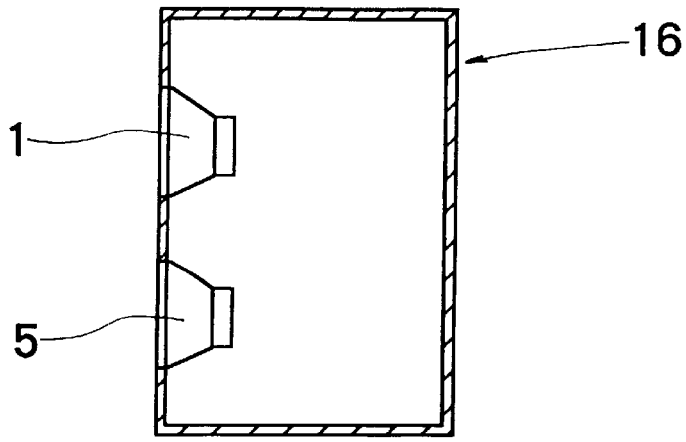
FIG. 2 is a partially sectional view showing a state in which a main speaker and a passive radiator are mounted to a closed type enclosure.
Figure 3:
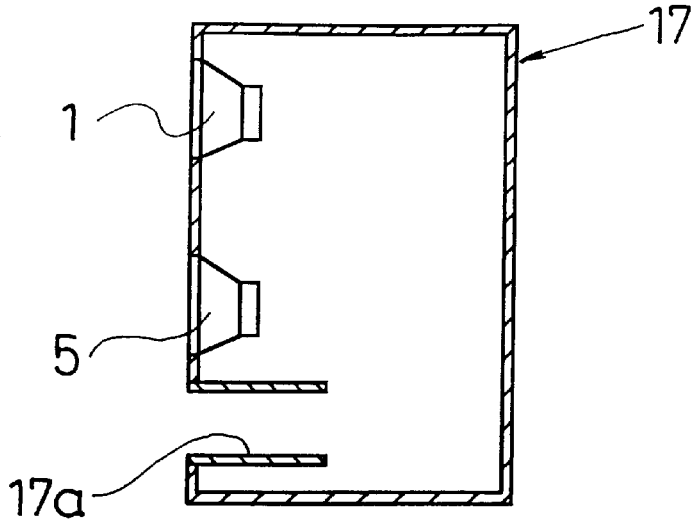
FIG. 3 is a partially sectional view showing a state in which a main speaker and a passive radiator are mounted to a bass-reflection type enclosure.

The main speaker 1 and the passive radiator 5 are mounted to a closed type enclosure 16 as shown in FIG. 2, or otherwise to a bass-reflection type enclosure 17 as shown in FIG. 3 In either of the cases, the passive radiator 5 is driven by the sound pressure behind the main speaker. In the case of the closed type enclosure 16, since the reverse phases on the front and rear surfaces of the corn 2 of the main speaker 1 and the corn 6 of the passive radiator 5 are shut down, the sound pressure attenuation due to the interference therebetween can be eliminated. This is an advantage in addition to the advantage mentioned in connection with the feed-back of the signal generated by the integrating MFB amplifier 13. In the case of the bass-reflection type enclosure 17, the vibration amplitudes of the main speaker 1 and the corn of the passive radiator 5 are restricted in the vicinity of the anti-resonance frequency at which Helmholtz resonance occurs between the air inside the enclosure and the air inside a port 17*a*. Therefore, by setting this anti-resonance frequency to be lower than the resonance frequency of the passive radiator 5 subjected to the feed-back, it is possible to reduce the sound pressure distortion in the super-low band requiring the corn 6 to vibrate at a large vibration amplitude.

When the circuit shown in FIG. 1 is activated, the passive radiator 5 positively generates the sound in accordance with the output of the power amplifier 8, not simply generate the sound through the resonance with the main speaker 1. Therefore, it is possible to cover the low band sufficiently even if both the main speaker 1 and the passive radiator 5 are small in diameter and are installed in an enclosure small in capacity.

Figure 4:
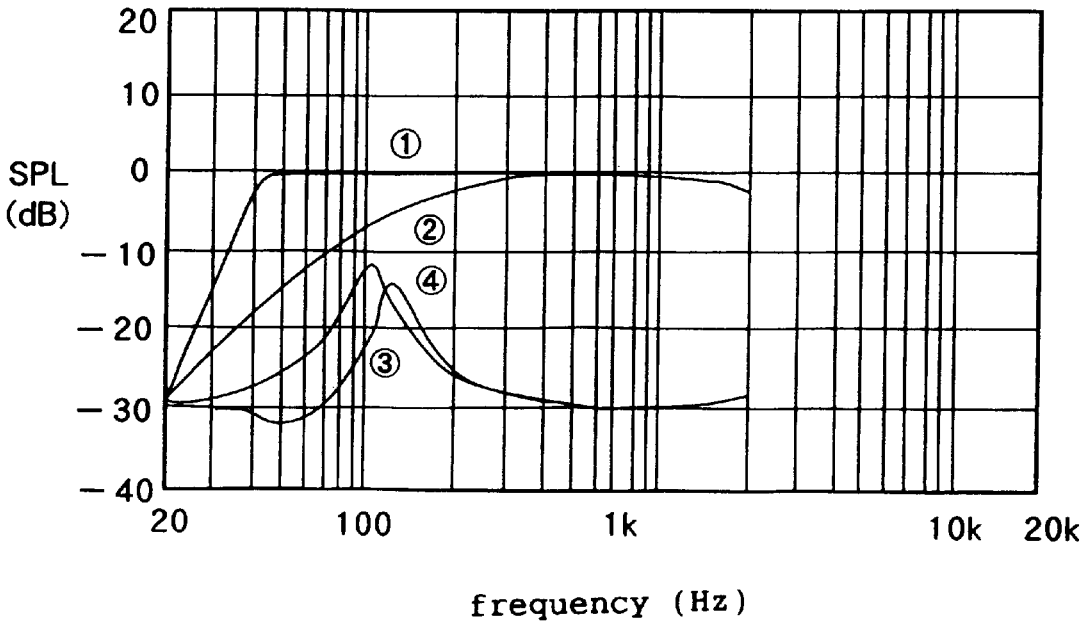
FIG. 4 is a characteristic diagram showing an advantage of the present invention employing the circuit shown in FIG. 1 and the enclosure shown in FIG. 2.

FIG. 4 is a graph of an example, showing a reproduced sound pressure characteristic in a semi-infinite space in a case where a main speaker unit having a diameter of 100 mm and a minimum resonance frequency of 80 Hz and a passive radiator having a diameter of 160 mm were mounted to an enclosure having a capacity of 7.5 liter. In FIG. 4, reference numeral 1 represents a passive radiator type employing a servo-control according to the present invention, and reference numeral 2 represents a characteristic of a comparative example in which the same speaker unit having a diameter of 100 mm was used in a closed type enclosure having a capacity of 7.5 liter. As shown, the bass reproduction limit frequency was about 160 Hz in the case of the closed type, whereas the arrangement according to the present invention could lower the bass reproduction limit frequency down to about 40 Hz. Since the bass reproduction limit frequency is about 80 Hz or more if the speaker unit used in this example is used in each of normal closed type, bass-reflection type and passive radiator type, it can be found out that the system according to the present invention remarkably enhances the bass reproduction performance of the speaker system. In addition, in FIG. 4, reference numerals 3 and 4 represent impedance characteristics of the main speaker units, which correspond to 1 and 2, respectively. It can be found out that, although the normal passive radiator type speaker system has two peaks, the system according to the present invention established a peak of only a high frequency due to the MFB and not only rendered a peak of a low frequency disappear but also decreased the impedance to be lower than a regulation value conversely.

One that shown in FIG. 1 is merely an example, and alternatively, the MFB signal can be obtained by detecting the vibration of the passive radiator using a displacement sensor, a vibration sensor, an acceleration sensor or the like, and this alternative example will provide a more preferable result.

Figure 5:
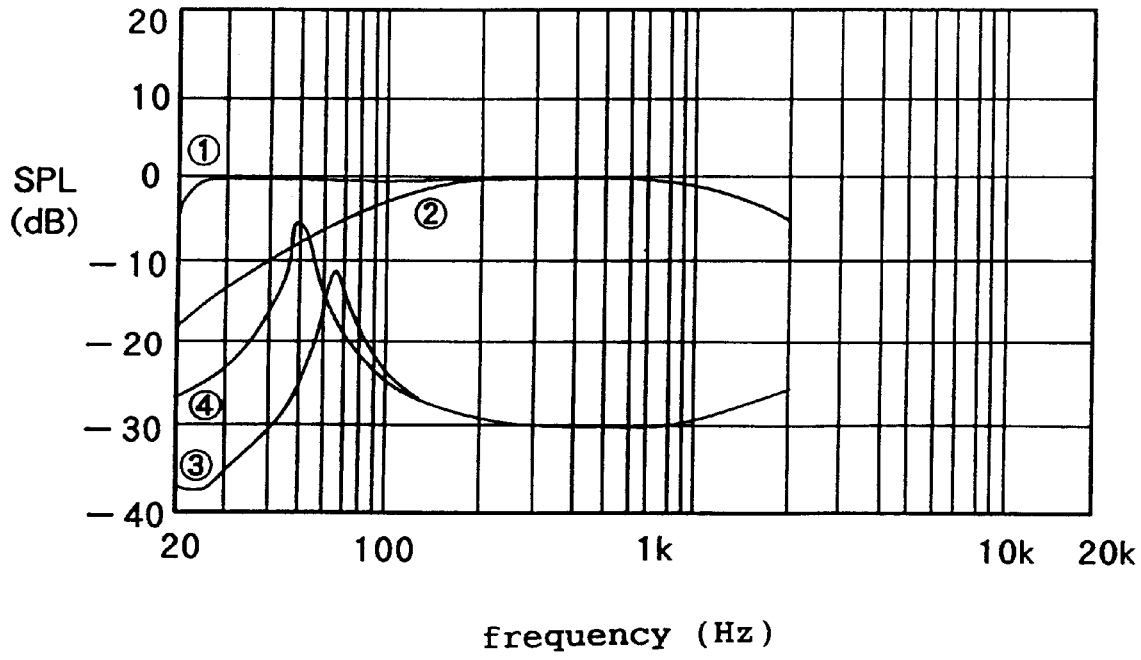
FIG. 5 is a characteristic diagram showing another advantage of the present invention.

As another example, a description will be given to a case in which a main speaker having a diameter of 160 mm and a passive radiator having a diameter of 180 mm were used in a closed-type enclosure having a capacity of 16 liter with the arrangement shown in FIG. 1. In this case, as represented by reference numeral 1 in FIG. 5, the sound pressure characteristic could be extended down to the super bass band not larger than 30 Hz. In addition, reference numeral 2 represents a characteristic in a case where the same main speaker unit is used in the same closed-type enclosure. Further, reference numerals 3 and 4 represent impedance characteristics of the main speaker units, which correspond to 1 and 2, respectively. It can be found out that, although the normal passive radiator type speaker system has two peaks, the system according to the present invention established a peak of only a high frequency due to the MFB and not only rendered a peak of a low frequency disappear but also decreased the impedance to be lower than a regulation value conversely As described above, the present invention provides a bass intensifying device for a speaker system, in which only a passive radiator is subjected to a motion feed back (MFB). Therefore, the following advantages can be obtained Since the MFB loop is closed only in the passive radiator, it is possible to intensify the bass without degrading the sound quality of the main unit due to the MFB loop. Therefore, the drive amplifier for the main unit can be selected freely.

The use of the servo-controlled passive radiator can cancel the stiffness, which acts on the passive radiator, with MFB, whereby the band to which the passive radiator is responsible can be widened toward the low band. The sound pressure characteristic could be extended to the super-bass band not larger than 50 Hz.

Since it is sufficient for an enclosure to have a capacity required only for the main unit, the passive radiator activation in the super-bass band can be realized with a small enclosure. Thus, the super-bass sound reproduction can be achieved with a main unit of a light-weight vibration mass and a small diameter and a super-small enclosure. Further, it is unnecessary to divide a cavity for the purpose of bass sound reproduction.

Since the main unit does not contribute to the bass sound reproduction, it is possible to reduce the cross modulation distortion remarkably in comparison to a general miniature speaker system.

What is claimed is:

1. A bass intensifying device for a speaker system, in which a passive radiator constructed by a speaker unit having a magnetic circuit and a voice coil is disposed at a location where it receives a sound pressure from a main speaker unit driven by an amplifier, and a motion feed-back circuit independently of a drive circuit of the main speaker unit is connected to the passive radiator, the main speaker unit and the passive radiator are installed in an enclosure and a corn of the passive radiator has access to outside of the enclosure, wherein a vibration of a diaphragm of the passive radiator caused by a sound pressure from the main speaker unit makes the voice coil vibrate to generate an audio signal therein, the audio signal is amplified in the motion feed-back circuit, and the amplified signal is applied to the voice coil, thereby the passive radiator generates a sound outside of the enclosure under a control of the motion feed-back circuit.

2. A bass intensifying device for a speaker system as set forth in claim 1, wherein the main speaker unit and the passive radiator are installed in a closed type enclosure.

3. A bass intensifying device for a speaker system as set forth in claim 1, wherein the main speaker unit and the passive radiator are installed in a bass-reflection type enclosure.

4. The bass intensifying device for a speaker as set for in claim 1, wherein the vibration of the diaphragm is detected by a detection means selected from a displacement sensor, a vibration sensor and an acceleration sensor.

* * * * *